US009192960B2

(12) United States Patent
Tanley et al.

(10) Patent No.: US 9,192,960 B2
(45) Date of Patent: Nov. 24, 2015

(54) CONTACT COATING BY USE OF A MANIFOLD PROVIDED WITH CAPILLARY TUBES

(71) Applicant: 3M INNOVATIVE PROPERTIES COMPANY, St. Paul, MN (US)

(72) Inventors: Chris J. Tanley, Woodbury, MN (US); Timothy J. Edman, Stillwater, MN (US); Gary W. Maier, Roberts, WI (US); David S. Grinnell, Chippewa Falls, WI (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 14/363,220

(22) PCT Filed: Dec. 13, 2012

(86) PCT No.: PCT/US2012/069511

§ 371 (c)(1),
(2) Date: Jun. 5, 2014

(87) PCT Pub. No.: WO2013/090575

PCT Pub. Date: Jun. 20, 2013

(65) Prior Publication Data

US 2014/0329019 A1 Nov. 6, 2014

Related U.S. Application Data

(60) Provisional application No. 61/570,147, filed on Dec. 13, 2011.

(51) Int. Cl.

| | |
|---|---|
| ***B05D 1/26*** | (2006.01) |
| ***B05C 5/02*** | (2006.01) |
| ***B05C 11/02*** | (2006.01) |
| ***B05D 1/02*** | (2006.01) |

(52) U.S. Cl.

CPC . *B05D 1/26* (2013.01); *B05C 5/027* (2013.01); *B05C 5/0245* (2013.01); *B05C 11/025* (2013.01); *B05D 1/02* (2013.01)

(58) Field of Classification Search

USPC ..... 427/424; 118/112, 313

See application file for complete search history.

(56) References Cited

U.S. PATENT DOCUMENTS

| | | | | |
|---|---|---|---|---|
| 3,201,275 | A | 8/1965 | Herrick | |
| 3,536,524 | A * | 10/1970 | Sisson | 427/355 |
| 4,748,043 | A | 5/1988 | Seaver | |
| 5,349,714 | A | 9/1994 | Korbonski | |
| 5,440,328 | A | 8/1995 | Nardone | |

(Continued)

FOREIGN PATENT DOCUMENTS

| | | |
|---|---|---|
| EP | 0436893 | 7/1991 |
| WO | WO 97-49538 | 12/1997 |

OTHER PUBLICATIONS

H. Benkreira, "Dynamic Wetting in Metering and Pre-Metered Forward Roll Coating," Dept. of Chemical Engineering, University of Bradford, Bradford, UK, Aug. 2002, p. 1-28.

(Continued)

*Primary Examiner* — Nathan T Leong
(74) *Attorney, Agent, or Firm* — Robert H. Jordan

(57) ABSTRACT

A coating apparatus and method of use wherein at least one capillary tube is in contact with a moving substrate during coating.

36 Claims, 3 Drawing Sheets

(56) References Cited

U.S. PATENT DOCUMENTS

| | | | | |
|---|---|---|---|---|
| 5,723,176 | A | 3/1998 | Keyworth | |
| 5,816,159 | A | 10/1998 | Chrigui | |
| 6,191,053 | B1 | 2/2001 | Chun | |
| 6,600,888 | B2 | 7/2003 | Mishra | |
| 6,676,754 | B1 | 1/2004 | Fleming | |
| 6,855,374 | B2 | 2/2005 | Leonard | |
| 8,257,794 | B2 * | 9/2012 | Wang et al. | 427/286 |
| 2003/0194526 | A1 * | 10/2003 | Vesley et al. | 428/64.1 |
| 2009/0011182 | A1 | 1/2009 | Mackley | |
| 2010/0047452 | A1 | 2/2010 | Wang | |

OTHER PUBLICATIONS

"Technical Coating International, Inc., Coating, Laminating & Converting of roll based Film. Foil. Paper & Fabric." Coating Techniques, Technical Coating International, Inc, 150 Backhoe Road Northeast Leland, NC, USA. URL<http://www.tciinc.com/coating.html>, [retrieved from the internet on Jul. 15, 2011], p. 1-3.

International Search Report for PCT International Application No. PCT/US2012/069511 mailed on Mar. 6, 2013, 3 pages.

* cited by examiner

CONTACT COATING BY USE OF A MANIFOLD PROVIDED WITH CAPILLARY TUBES

FIELD

The invention relates to a capillary tube coating apparatus for continuous coating of a moving substrate, and methods of its use.

BACKGROUND

There is an ongoing need for an inexpensive and reliable coating apparatus which can be used to coat viscous fluids continuously and controllably on a wide web with excellent downweb and crossweb uniformity and controllable coating width. Coating die methods suffer from the drawback that it is difficult to fabricate a wide die with excellent crossweb thickness uniformity, and the cost and weight of the die become prohibitive as the width is increased. Rolling bank methods suffer from the drawbacks of being difficult to control in terms of both coating weight and coating width, and have a tendency toward coating thickness variability. The inability to precisely control coating width on a wide web leads to waste, e.g., in the form of uncoated web, material, spilled coating fluid, etc. Further, once such a coating process has been brought under control, changing any variable, such as the viscosity of the coating fluid, or the desired finished thickness of the coating, or the line speed, requires laborious trial-and-error changes to many of the other variables in order to regain control of the coating process.

The use of capillary tubes in a coating device is known. Many capillary tube coating methods involve providing a reservoir or rolling bank of coating fluid on the substrate being coated. This reservoir must be metered using an additional device, such as a nip roll. Control of such a system is difficult. U.S. Pat. No. 8,257,794 (Wang et al.) discloses another known capillary tube coating method which does not use a rolling bank wherein the capillary tube is first brought into contact with the substrate to be coated in order to commence the flow of the coating fluid, and then withdrawn to a precise distance from the surface in order to maintain the flow during coating. Such a system is also difficult to control. Other common drawbacks to known capillary tube coating methods is that they force a choice between droplet-wise dispensing of the coating fluid, or high-velocity high-volume jet flow, rather than permit continuous dispensing of a controlled flow.

The need exists for an inexpensive and reliable coating apparatus which can be used to coat viscous fluids continuously and controllably on a wide web with excellent downweb and crossweb uniformity and controllable coating width.

SUMMARY

The present invention provides an inexpensive and reliable coating apparatus which can be used to coat viscous fluids continuously and controllably on a web, including if desired wide webs, with excellent downweb and crossweb uniformity and controllable coating width. The invention also provides a method of coating using such an apparatus.

In brief summary, a coating apparatus of the invention comprises at least one, typically a plurality of, capillary tube having a discharge end, at least one capillary tube manifold in communication with the at least one capillary tube, at least one continuous pumping device to supply the at least one capillary manifold with fluid, and at least one displacement device, wherein the apparatus is adapted to position and then maintain the discharge end of the at least one capillary tube in physical contact with a moving substrate so as to deposit fluid onto the substrate.

Briefly summarizing, the process of the invention comprises the steps of:

providing at least one moving substrate;

positioning a coating apparatus in proximity to the substrate, the coating apparatus comprising at least one capillary tube having a discharge end, at least one capillary tube manifold in communication with the capillary tube, at least one continuous pumping device to supply the capillary manifold with fluid, and at least one displacement device, wherein the apparatus is adapted to position and then maintain the discharge end of the at least one capillary tube in physical contact with a moving substrate so as to deposit fluid onto the substrate with no rolling bank;

activating the displacement device in such a manner as to cause the capillary tube, at its discharge end, to make physical contact with the moving substrate;

operating the continuous pumping device so as to deliver a fluid to be coated to the capillary manifold; and maintaining physical contact between the discharge end of the capillary tube and the moving substrate throughout the duration of the deposition of the fluid to be coated onto the substrate.

BRIEF DESCRIPTION OF DRAWINGS

The invention is further explained with reference to the drawing wherein.

These figures are not to scale and are intended to be merely illustrative and not limiting. Like reference numbers are used to represent equivalent components in each Fig.

DETAILED DESCRIPTION OF ILLUSTRATIVE EMBODIMENTS

Figure 1:
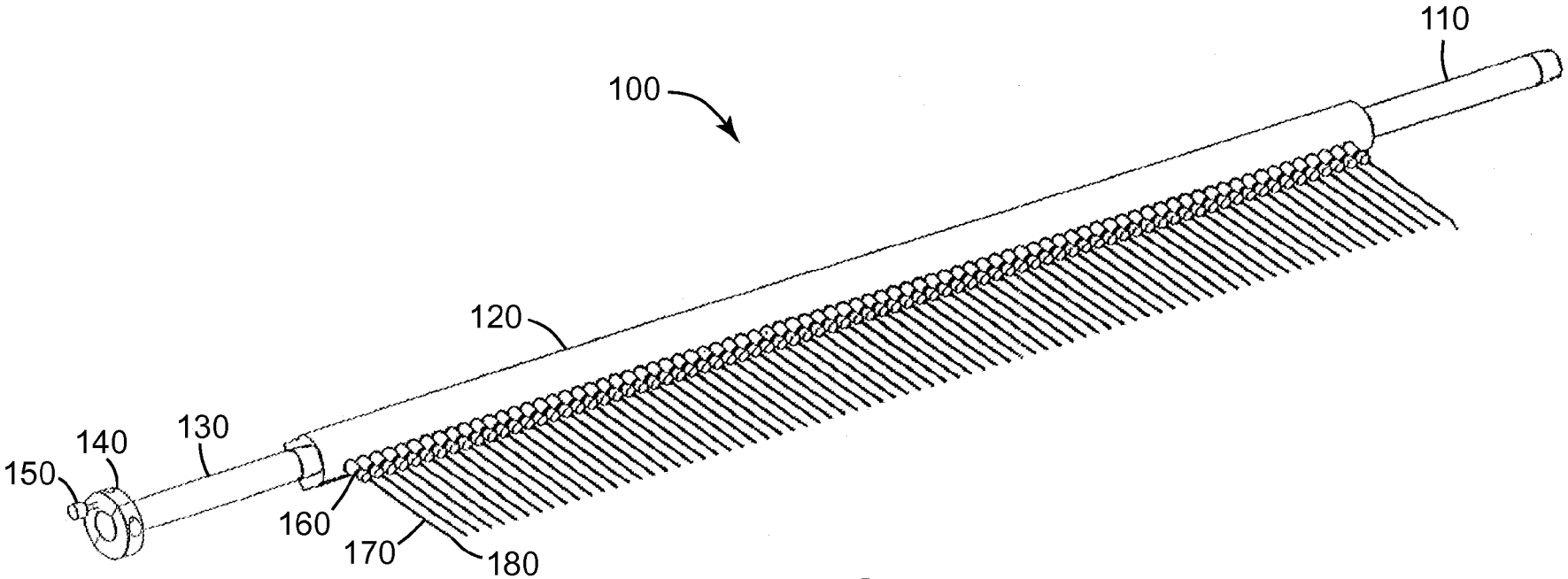
FIG. 1 is a schematic view of a capillary manifold having a plurality of capillary tubes.

The capillary effect is the ability of a liquid to flow against gravity or other imposed forces such that, in the static case (gravity alone, no other imposed forces), liquid spontaneously rises in a narrow space such as a thin tube, or in porous materials such as paper or in some non-porous materials such as liquefied carbon fiber. The effect occurs because of intermolecular attractive forces between the liquid and solid surrounding surfaces. If the diameter of a tube is sufficiently small, then the combination of surface tension (which is caused by cohesion within the liquid) and forces of adhesion between the liquid and container act to lift the liquid some length up the tube.

In a sufficiently narrow circular cross-section (radius a), the interface between two fluids (for example, water and air) forms a meniscus that is a portion of the surface of a sphere with radius R. The pressure difference across this surface is:

$$\Delta p = \frac{2\gamma}{R}.$$

This may be shown by writing the Young—Laplace equation in spherical form with a contact angle boundary condition and also a prescribed height boundary condition at say, the bottom of the meniscus.

The solution is a portion of a sphere, and the solution will exist only for the pressure difference shown above. The radius of the sphere will be a function only of the contact angle, θ, which in turn depends on the exact properties of the fluids and the solids in which they are in contact:

$$R = \frac{a}{\cos\theta}$$

so that the pressure difference may be written as:

$$\Delta p = \frac{2\gamma\cos\theta}{a}.$$

In order to maintain hydrostatic equilibrium, the induced capillary pressure is balanced by a change in height, h, which can be positive or negative, depending on whether the wetting angle is less than or greater than 90°. For a fluid of density p:

$$h = \frac{2\gamma\cos\theta}{\rho g r},$$

where γ is the liquid-air surface tension (force/unit length), θ is the contact angle, p is the density of liquid (mass/volume), g is local gravitational field strength (force/unit mass), and r is radius of tube (length).

For a water-filled glass tube in air at standard laboratory conditions, γ is 0.0728 N/m at 20° C., θ is 20° (0.35 radians), p is 1000 kg/m$^3$, and g is 9.8 m/s$^2$. For these values, the height of the water column is $$h \approx \frac{1.4\times10^{-5}}{r}.$$

Thus for a 4 m (13 fl) diameter glass tube under lab conditions (radius is 2 m (6.6 ft)), the water would rise an unnoticeable 0.007 mm (0.00028 in). However, for a 4 cm (1.6 in) diameter tube (radius is 2 cm (0.79 in)), the water would rise 0.7 mm (0.028 in), and for a 0.4 mm (0.016 in) diameter tube (radius 0.2 mm (0.0079 in)), the water would rise 70 mm (2.8 in). Such a tube is sufficiently narrow to be regarded as a capillary tube.

In order to use an array of capillary tubes as an effective substitute for a coating die, the capillary forces must be overcome. Otherwise, no fluid will exit the capillary tubes, even if they are oriented so as to have the pull of gravity in the same direction as the intended direction of coating flow. The capillary forces can be overcome by the application of pressure, such as from a pump. However, we have noted that there are two regimes for the flow from a capillary tube under imposed pressure from a pump. At low imposed pressures, fluid will exit the capillary tube in the form of individual drops. This is inefficient for coating purposes. The second regime requires much higher pressures, and the result is a high-velocity jet of fluid exiting the capillary tube. This regime is also inconvenient for coating operations, as it generally results in greater flow than needed. These behaviors are similar to the well-known behaviors of an eye-dropper.

In the present invention, the fluid pressure in the capillary tubes, i.e., pressure imparted by the continuous pump feeding the capillary tube manifold or static head pressure imparted by the configuration of the fluid supply in the capillary manifold, is sufficiently low that when the discharge ends of the capillary tubes are not in physical contact with a substrate, i.e., they are disposed in free space, no fluid is discharged therefrom.

We have surprisingly discovered that the capillary forces can be overcome at moderate imposition of pressure simply by bringing the discharge end of a capillary tube into physical contact with the moving substrate to be coated. Under such conditions, the flow from the capillary tube has a parabolic profile in the plane of the substrate, is stable, and can be moderate in flow rate. No droplets or high-velocity jets are formed. Further, effective control of the flow rate, and hence the final coating thickness, is easily attained simply by adjusting the throughput rate of the pump. As a result of this operating regime, the present invention makes it possible to coat fluids over a surprisingly wide range of viscosities as well as to achieve uniform fluid coatings having surprisingly low coating weights.

It is counter-intuitive to touch the surface of the moving substrate with any part of the coating apparatus, as this would quite reasonably be expected to lead to scratching the substrate. However, we have also surprisingly discovered that two factors are each independently capable of greatly diminishing such scratching. First, tapering, machining or otherwise treating the discharge end of the capillary tube so as to have no sharp edges or rough edges is very helpful in reducing scratching. Also significant, and quite surprising, is the discovery that if the physical contact between the discharge end of the capillary tube and the moving substrate is at least close to a tangential contact (i.e., within 5°, preferably within 2° of tangential contact), smooth flow at moderate imposed pumping pressure is maintained, while scratching is practically eliminated. Best results are obtained by employing both capillary tube discharge ends with no sharp or rough edges, and tangential contact to the moving substrate. In the case in which both of these considerations are adequately met, we have observed that it is possible to eliminate completely any scratching, even though the discharge ends of the capillary tubes remain in physical contact with the moving substrate throughout the duration of coating process.

Turning now to the Figures, which are meant to be illustrative of features of the present invention and not limiting, FIG. 1 shows a schematic diagram of a portion of the coating apparatus of the present invention, the capillary manifold unit 100. The manifold inlet pipe 110 accepts the coating fluid, directly or indirectly, from a continuous pumping device (not shown) and conveys the fluid into the capillary manifold 120. The capillary manifold is stoppered at its opposite end by the manifold plug 130. The capillary manifold unit 100 may optionally be equipped with all of or some parts of a displacement device adapted to cause the discharge ends 180 of the capillary tubes 170 to be moved, as desired, into direct contact and out of direct contact with a moving substrate (not shown). In the illustrative embodiment of FIG. 1, a follower cam mount 140, and a flat track roller 150, are shown. Their role in the working of an illustrative displacement device can be seen by reference to FIG. 3. A plurality of housings 160 are shown. These may be any secure means for affixing the plurality of capillary tubes 170 to the capillary manifold 120 in communication such that fluid can flow from the capillary manifold 120 to discharge ends 180. An example of such a housing would be a luer lock-to-thread adapter. Each capillary tube 170 has a discharge end 180. These discharge ends should all be arranged such that they are as close to collinear as possible, within engineering tolerances.

Figure 2:
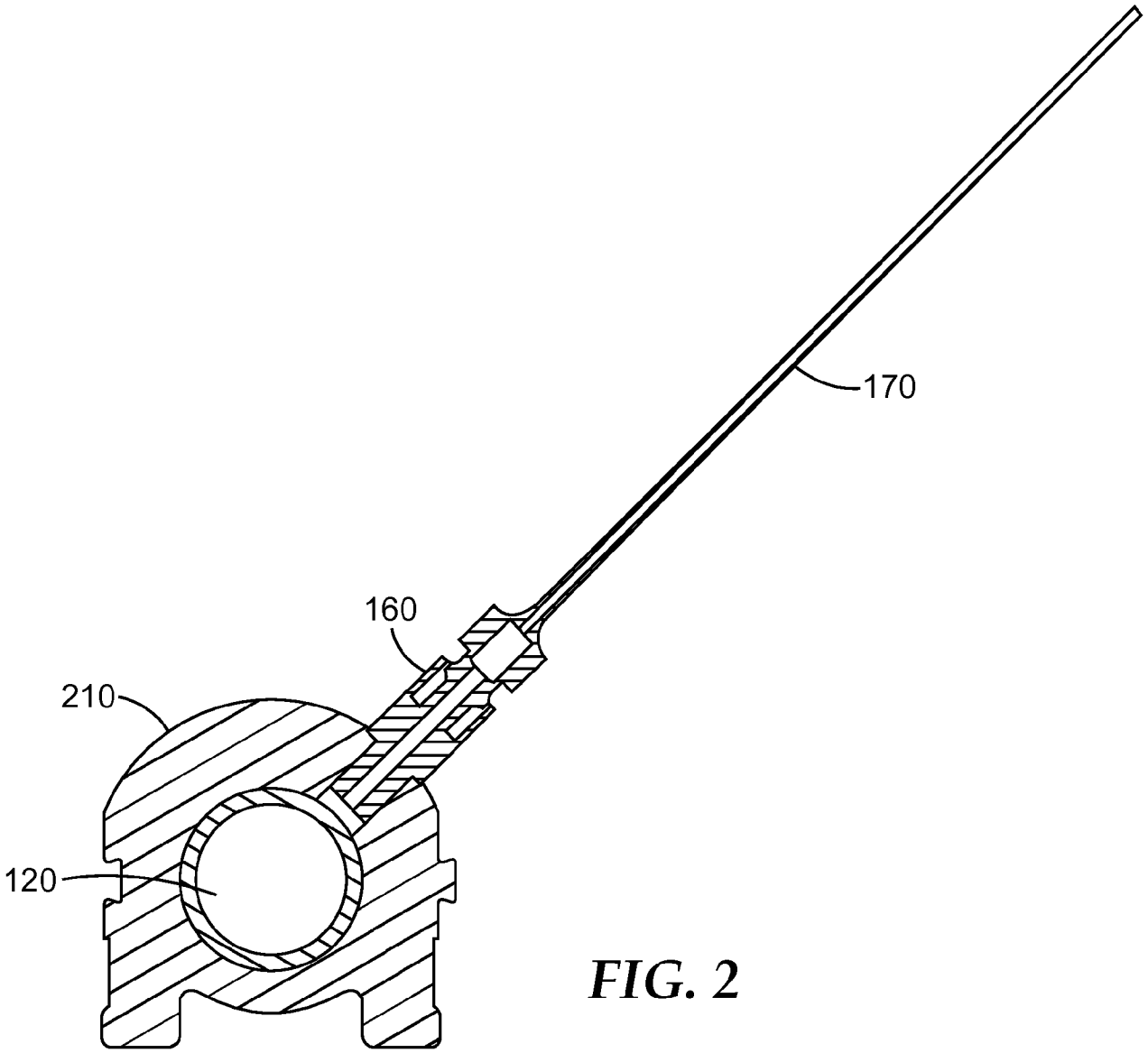
FIG. 2 is a schematic view of one capillary tube connected to the capillary manifold.

FIG. 2 shows schematically but in more detail a cross-section view of one capillary tube 170, its housing 160, the capillary manifold 120, and a support structure 210 for holding the capillary manifold in place in the coating apparatus.

Figure 3:
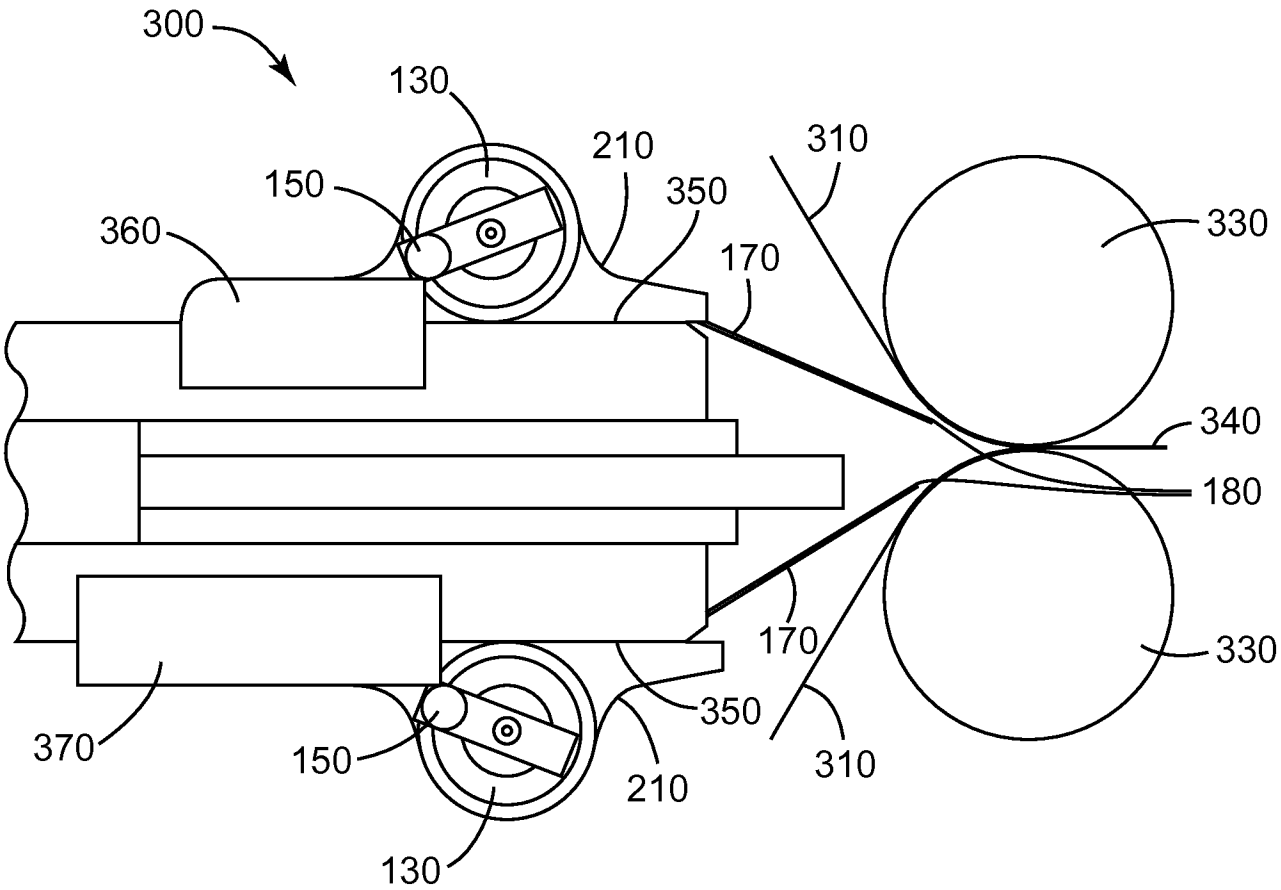
FIG. 3 is a schematic side view of one illustrative coating apparatus of the present invention.

FIG. 3 shows a schematic diagram of one particular illustrative embodiment of the coating apparatus 300, except for the at least one continuous pumping device (not shown—obscured behind the visible parts from this perspective). It is contemplated that the coating apparatus 300 of the present invention can be configured to apply one coating to one moving substrate, or to apply two or more coatings, which may be the same or different, to one or more moving substrates 310, which may be the same or different. Different ultimate purposes for such multiple coatings on multiple moving substrates 310 are contemplated, and will be apparent to one of ordinary skill in the coating or web-processing art. For the purposes of illustrating some of the contemplated design features, FIG. 3 shows schematically a coating apparatus 300 intended to apply two coatings onto two moving substrates 310 for the purpose of uniting the two moving substrates adhesively in a nip-roll laminator 320. The nip roll laminator 320 has two rolls 330 in nipping contact. Two moving substrates 310 are first coated and then brought together in the nip-roll laminator 320 to form the laminated product 340. Capillary tubes 170 are shown in a position just short of tangential physical contact with the moving substrates 310. Because of the perspective of FIG. 3, only one from each set of capillary tubes 170 can be seen approaching each moving substrate 310—others, when present, would be directly behind the two shown in this view, preferably arranged in collinear fashion as shown in FIG. 1. The ends of the manifold plugs 130 can be seen. The capillary manifolds 120 would be directly behind them in this perspective. Two flat track rollers 150 are shown. Support structures 210 are shown. Each is mounted on a translational slide 350. The capillary tubes 170 are mounted in such a way that they will be brought into tangential physical contact with the moving substrates 310 by just a small translation, from left to right in this view, of the translational slides 350.

Due to machining tolerances and other factors, is it unlikely, particularly for a large array of capillary tubes 170, that each of the discharge ends 180 will be precisely collinear. Hence, it may occur that not all discharge ends 180 of capillary tubes 170 will make physical contact with a moving substrate 310 simultaneously as the displacement device is activated. This problem can be solved by ensuring that the capillary tubes 170 are fabricated from a flexible material, so that those which make physical contact first with moving substrate 310 will flex slightly, rather than gouging into the moving substrate 310, as the translational slides 350 continue to be translated from left to right until all capillary tubes 170 have made physical contact with moving substrates 310. It is still important that tolerances be held very tight, so that when all capillary tubes 170 are in physical contact with the moving substrates 310, the points of contact should all be at the discharge ends 180. If one or more capillary tubes 170 is/are making contact with a moving substrate 310 at a point too distant from the discharge end 180, it is likely that the coating fluid will not exit that capillary tube, and it may need to be shortened or re-oriented in order to bring its discharge end 180 into collinearity with others.

In the embodiment illustrated, the uppermost of the two flat track rollers 150 rides along a curved block 360 as the uppermost of the translational slides 350 is translated. This allows, during the retraction event (translation from right to left), for the capillary tubes 170 to swing upwards and out of the way for cleaning or other purposes, once the uppermost flat track roller 150 reaches the curved portion at the left end of the curved block 360. The lowermost of the two flat track rollers 150 rides along a long straight block 370 in the illustrative figure. It will be understood that either or both flat track rollers 150 could ride on a curved block 360 or a long straight block 370, as desired. It is also contemplated that many different types of displacement device are possible. For example, the capillary tubes 170 may be brought into contact with the moving substrates 310 via a rotational rather than a linear translational motion. Also, in the case illustrated in FIG. 3, with two coatings being applied to two moving substrates 310, two displacement devices may move in concert or independently. The use of different displacement devices is also contemplated, and will be readily selected by those skilled in the art. For instance, one may be a translational slide 350 as shown in FIG. 3 while the other is of a rotational type.

The number of capillary tubes 170 in an array is not limited. Factors including substrate width, line speed, desired coating thickness, and coating fluid viscosity will impact the number and spacing of the capillary tubes 170. If it is desired for the applied coating to be unitary and uniform in thickness cross-web prior to encountering the next piece of process equipment in-line (here, the nip rolls), the capillary tubes will need to be placed closely enough together to accommodate "leveling" at the viscosity of the coating fluid. On the other hand, a nipping apparatus, as shown in FIG. 3, can be used to aid in leveling. This, however, stands in contrast to a rolling bank system, in which nip rolls play a metering role and helps to determine coating weight as well as cross-web thickness uniformity.

The nature and location of the displacement device is not particularly limited. Its function is to move the discharge ends of the capillary tubes into contact, preferably into tangential contact, with the moving substrate. As such, it can move the capillary tubes themselves, or any more-inclusive sub-assembly of the coating apparatus which includes the capillary tubes. The movement can be linear or rotary, depending on configuration and other details.

Coating fluid viscosity is also not particularly limited. Adhesives in the viscosity ranges between about 200 to about 325 Centipoises (cP) have been successfully coated. It is believed that coating fluids with viscosities much higher—perhaps orders of magnitude higher—can be coated according to this invention. In an effort to find a lower limit on viscosity, pure acetone was coated (viscosity of approximately 0.3 cP). In a two-coating system similar to that illustrated in FIG. 3, coating the lower substrate was similar to what it had been for the 200 to 325 cP viscosity range. Coating the upper substrate was more challenging. Applying such a low viscosity coating is such an upside-down orientation (with respect to gravity) is more difficult. The capillary tubes need to be adjusted much more precisely for tangential contact, and the deflection of flexible capillary tubes necessary to bring all tubes into physical contact with the moving substrate was more difficult for the low viscosity fluid, causing some product scratching. Continuous coatings were obtained, however, and it appears that the effect of a low viscosity coating fluid is simply to make precise tolerances more important. If two or more capillary manifolds are used, they may be supplied by the same or different continuous pumping devices. If desired, they may be supplied with the same or different coating fluids.

The process of for continuous coating using the apparatus of this invention proceeds as follows, with reference to FIG. 3. It will be understood by one of ordinary skill in the art that this description of procedures would be adjusted appropriately for the use of an embodiment of the present invention that differed in certain details from the embodiment shown in FIG. 3.

The procedure begins with the capillary tubes 170 retracted and out of the way, via movement of the translational slides 350, or other displacement device(s). Then, the coating station is "threaded"—The moving substrates 310 are started on their way through the apparatus. With the moving substrates 310 threaded and already in motion, the translational slides 350 are moved from left to right on FIG. 3, until the discharge ends 180 of the capillary tubes 170 are in (near-tangential) physical contact with the moving substrates 310. The continuous pumping device (not shown) is then started and adjusted to a predetermined speed suited to the desired coating weight. An operator observes whether each of capillary tubes 170 is making contact, and delivering a steady stream of coating fluid to the moving substrates 310. If there are any which are not performing acceptably, minor adjustments are made, using the translational slides 350 or fine tuning displacement devices (not shown) which may also have been installed in the apparatus. The operator also checks for scratches on the moving substrates 310 at a point beyond the point at which the coating is being applied. Many techniques are possible. One such technique is to observe the film between crossed polarizers, one placed above and one placed below the film. If any scratches are present (and assuming all capillary tubes 170 have been properly fabricated to have no sharp or rough edges at their discharge ends 180), fine adjustments are made once again, in order to bring all physical contacts as close to tangent as possible. The laminated product 340 may be analyzed on-line or off-line for coating weight, and adjustments may be made to the continuous pumping device to adjust the coating weight.

The apparatus and process of the current invention has wide application to several types of coating applications involving various spreading techniques. One such coating application is nip roll dual lamination, as shown schematically in FIG. 3. There are likely to be applications in pre-tenter coating on film lines (coating a film in-line during its manufacture at a point on the film-making line at which the film has not yet been stretched in the transverse direction). Other applications would include films with surface characteristics which make them difficult to coat by other techniques. Films can be supplied from a roll or directly from a film-making line in continuous operation with the apparatus of the invention.

The inventive apparatus and methods of use should enable improved continuous operation of coating lines when the input film to be coated contains web splices, because nip roll pressure is not being used to meter coating weight (coating thickness) as it is in rolling bank coating processes.

EXAMPLE

The invention will be further explained with the following illustrative example.

A coating apparatus similar to that of FIG. 3 was fitted with two series of forty-seven (47) 16-gauge stainless steel capillary tubes installed into the manifold. The two sides of the coating apparatus each had the ability to rotate and slide onto a precision dead stop position at a tangent angle to the respective nip roll. The two sides of the coating apparatus were each supplied by a VIKING™ CMD E02 gear pump (Viking Pump, IDEX Corp., Cedar Falls, Iowa), and the connection between the gear pumps and manifolds was ½ inch polymeric tubing. The precision dead stops were configured such that the physical contact angle could be adjusted closer to tangent if the capillary tube discharge ends contacting the moving substrate caused scratches. One difference from FIG. 3 is that a third film was fed to the nip roll laminator such that it was sandwiched in between the two adhesive-coated films. The two outer films which received the coating of laminating adhesive were continuous PET films, with a film width of 670 mm. The central film was a multilayer optical film (a VIKUITI™ Dual Brightness Enhancement Film, 3M, St. Paul, Minn.) with a film width of 648 mm. The coating fluid was an acrylate copolymer optical adhesive having a viscosity of about 325 cP. A continuous coating of adhesive 0.5 mil (12.7 microns) thick was coated onto each of the PET moving substrates. The finished product was inspected. The thicknesses of the input films plus the coating thicknesses resulted in a finished product having an overall average thickness of 340 microns. The Variance was only 1.42 microns, and the Standard Deviation was only 1.19 microns, both results considerably better than results obtained on the same product construction using prior coating techniques.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

The invention claimed is:

1. A coating apparatus for continuous coating upon at least one moving substrate on a roll, comprising at least one capillary tube having a discharge end, at least one capillary tube manifold in communication with the at least one capillary tube, at least one continuous pumping device to supply the at least one capillary manifold with fluid, and at least one displacement device, wherein the apparatus is adapted to position and then maintain the discharge end of the at least one capillary tube within 5° of tangential contact with a moving substrate at a portion on a roll so as to deposit fluid onto the substrate.

2. The coating apparatus of claim 1 comprising a plurality of capillary tubes, each capillary tube having a discharge end.

3. The coating apparatus of claim 2 wherein the plurality of discharge ends are effectively collinear.

4. The coating apparatus of claim 3 wherein the plurality of capillary tubes is fabricated from a flexible material.

5. The coating apparatus of claim 1 comprising at least two capillary manifolds.

6. The coating apparatus of claim 5 wherein the at least two capillary manifolds are configured such that at least two separate fluids, of either the same or different compositions, can be deposited upon one moving substrate.

7. The coating apparatus of claim 5 wherein the at least two capillary manifolds are configured such that at least two separate fluids, of either the same or different compositions, can be deposited upon at least two moving substrates.

8. The coating apparatus of claim 1 wherein the at least one displacement device moves the entire coating apparatus.

9. The coating apparatus of claim 1 wherein the at least one displacement device moves the at least one capillary manifold with respect to the center of mass of the coating apparatus.

10. The coating apparatus of claim 1 wherein the at least one displacement device moves the at least one capillary tube with respect to the center of mass of the at least one capillary manifold.

11. The coating apparatus of claim 1 wherein the at least one displacement device is capable of causing movement of the discharge end(s) of the at least one capillary tube in a linear translational direction with respect to some reference point on the apparatus, or in a rotary direction with respect to the at least one capillary tube manifold, or both, either simultaneously or sequentially.

12. The coating apparatus of claim 1 further comprising at least one moving substrate, wherein the discharge end(s) of the at least one capillary tube are in physical contact with the at least one moving substrate.

13. The coating apparatus of claim 12 further comprising a spreading device, such that a location on the at least one moving substrate encounters the spreading device after the physical contact with the at least one capillary tube.

14. The coating apparatus of claim 13 wherein the spreading device is a nip roll.

15. The coating apparatus of claim 13 wherein the spreading device does not also serve as a coating weight metering device.

16. The coating apparatus of claim 1 wherein the discharge end(s) of the at least one capillary tube is/are tapered.

17. The coating apparatus of claim 1 wherein the discharge end(s) of the at least one capillary tube is/are surface-conditioned to preclude sharp or rough edges.

18. A process for continuous coating upon at least one moving substrate, comprising the steps of:

providing at least one moving substrate on a roll, positioning a coating apparatus in proximity to the at least one moving substrate, the coating apparatus comprising at least one capillary tube having a discharge end, at least one capillary tube manifold in communication with the at least one capillary tube, at least one continuous pumping device to supply the at least one capillary manifold, and at least one displacement device, activating the at least one displacement device in such a manner as to cause the at least one capillary tube, at its discharge end, to make physical contact with a portion of the at least one moving substrate on a roll, operating the at least one continuous pumping device so as to deliver a fluid to be coated to the at least one capillary manifold, and maintaining the discharge end of the at least capillary tube within 5° of tangential contact with the at least one moving substrate, throughout the duration of the deposition of the fluid to be coated onto the at least one moving substrate.

19. The process of claim 18 wherein the at least one capillary tube comprises a plurality of capillary tubes, each capillary tube having a discharge end, such that the plurality of capillary tubes has a plurality of discharge ends.

20. The process of claim 19 wherein the plurality of discharge ends is effectively collinear while in physical contact with the moving substrate.

21. The process of claim 20 wherein the capillary tubes are flexible, the plurality of discharge ends is made collinear while in physical contact with the moving substrate via urging the capillary tubes into contact with the moving substrate by the displacement device.

22. The process of claim 18 wherein there are at least two capillary manifolds, at least two moving substrates, at least two displacement devices, and at least one capillary tube housed in each capillary manifold, and wherein the at least one capillary tube housed in the first capillary manifolds is moved by the first displacement device in such a manner as to cause the at least one capillary tube, at its discharge end, to make physical contact with the first moving substrate, and the at least one capillary tube housed in the second capillary manifolds is moved by the second displacement device in such a manner as to cause the at least one capillary tube, at its discharge end, to make physical contact with the second moving substrate.

23. The process of claim 22 wherein there is one continuous pumping device which supplies the at least two capillary manifolds.

24. The process of claim 22 wherein there are at least two continuous pumping devices which supply the at least two capillary manifolds.

25. The process of claim 24 wherein the at least two continuous pumping devices supply the same coating fluid to the at least two capillary manifolds.

26. The process of claim 24 wherein the at least two continuous pumping devices supply at least two different coating fluids to the at least two capillary manifolds.

27. The process of claim 18 wherein activating the at least one displacement device in such a manner as to cause movement of the discharge end(s) of the at least one capillary tube in a linear translational direction with respect to some reference point on the apparatus, or in a rotary direction with respect to the at least one capillary tube manifold, or both, either simultaneously or sequentially.

28. The process of claim 18 wherein the physical contact is tangential contact.

29. The process of claim 18, further comprising transporting the at least one moving substrate to a spreading device.

30. The process of claim 29, wherein the spreading device is a nip roll.

31. The process of claim 29, wherein the at least one moving substrate bear(s) a uniform continuous coating after the action of the spreading device.

32. The process of claim 18 wherein no rolling bank of coating fluid is formed on the at least one moving substrate.

33. The process of claim 18 wherein the at least one moving substrate is a film supplied from a roll.

34. The process of claim 18 wherein the at least one moving substrate is a film supplied continuously from a film-making line.

35. The process of claim 18 wherein the moving substrate is a film on a film-making line, and further comprising the step of subsequently stretched the film on-line after coating.

36. The process of claim 18 wherein the at least one moving substrate includes web splices.

* * * * *